US005455979A

United States Patent [19]

Bores et al.

[11] Patent Number: 5,455,979

[45] Date of Patent: Oct. 10, 1995

[54] APPARATUS FOR MONITORING CLEANING ELEMENT WEAR

[75] Inventors: Frederick M. Bores, Highlands Ranch; Robert O'Hara; Mark Betker, both of Castle Rock, all of Colo.

[73] Assignee: Windsor Industries, Inc., Colo.

[21] Appl. No.: 139,411

[22] Filed: Oct. 20, 1993

[51] Int. Cl.[6] ..... A46B 9/00; A46B 13/02

[52] U.S. Cl. ..... 15/179; 15/DIG. 5; 15/180; 15/207.2; 15/159.1

[58] Field of Search ..... 15/159.1, 179, 15/180, 182, 207.2, DIG. 5

[56] References Cited

U.S. PATENT DOCUMENTS

| | | | |
|---|---|---|---|
| 2,459,007 | 1/1949 | Taylor | 15/383 |
| 2,659,921 | 11/1953 | Osborn | 15/182 |
| 2,682,675 | 7/1954 | Prucha | 15/180 |
| 2,754,531 | 7/1956 | Rowland | 15/DIG. 5 |
| 2,978,726 | 4/1961 | Park | 15/DIG. 5 |
| 3,106,733 | 10/1963 | Le Counte | 15/52.1 |
| 3,716,889 | 2/1973 | Goldstein | 15/366 |
| 3,761,986 | 10/1973 | Rickel | 15/183 |
| 3,771,189 | 11/1973 | Horton | 15/179 |
| 4,422,202 | 12/1983 | Malvasio | 15/106 |
| 4,802,255 | 2/1989 | Breuer et al. | 15/159 A |
| 4,912,805 | 4/1990 | Krasznai | 15/182 |

FOREIGN PATENT DOCUMENTS

| | | | |
|---|---|---|---|
| 1090988 | 11/1967 | United Kingdom | 15/DIG. 5 |
| 1321081 | 6/1973 | United Kingdom | 15/DIG. 5 |
| 8502522 | 6/1985 | WIPO | 15/180 |

*Primary Examiner*—David A. Scherbel
*Assistant Examiner*—Randall E. Chin
*Attorney, Agent, or Firm*—Sheridan Ross & McIntosh

[57] ABSTRACT

The present invention discloses the use of wear measuring elements to monitor the wear of cleaning elements on cleaning devices, such as cleaning machines and vacuum cleaners. The wear measuring elements are located adjacent to cleaning elements and have a length corresponding to a minimum desired length for the cleaning elements. When the length of the cleaning elements decreases due to usage to the length of the wear measuring elements, the user will realize that the cleaning elements need replacement.

23 Claims, 7 Drawing Sheets

APPARATUS FOR MONITORING CLEANING ELEMENT WEAR

FIELD OF THE INVENTION

The present invention relates to an apparatus for monitoring the degree of wear for cleaning elements. More specifically, the present invention provides an apparatus for indicating when the cleaning elements need replacement.

BACKGROUND OF THE INVENTION

Cleaning machines, such as floor scrubbers and vacuum cleaners, are commonly used to remove dirt and other debris from various surfaces. The surfaces may be either soft surfaces, such as carpeted floors, or hard surfaces, such as concrete, wood, or tile floors. Typically, cleaning machines use numerous cleaning elements, such as brushes, mounted on a rotating disk or cylinder to remove dirt and debris from the surface. As used herein, "cleaning element" refers to a raised area or projection that removes dirt or other debris from a surface by frictional forces. Cleaning machines may employ a variety of liquid cleaning agents to assist in removing dirt and debris.

Brushes, and other types of cleaning elements, in cleaning machines will wear and decrease in length over time causing numerous problems. The cleaning efficiency of the cleaning elements, especially brushes, decreases as the length of the elements decreases. For example, the bristles in cleaning brushes grow stiffer as length decreases, thereby causing dirt to be "flicked" by the brush away from the suction intake of the cleaning machine. As a result, less dirt is removed from the surface. The bristles in the brush also may become spread out and/or become flattened, decreasing the degree of agitation or scrubbing of the surface and therefore the cleaning efficiency of the brush.

In light of cleaning element wear, timely replacement of the cleaning elements is an important factor in controlling cleaning costs. If cleaning elements are not replaced when overworn, the inefficiency of the cleaning machine will require increased man hours to clean the surface adequately. If cleaning elements are replaced prematurely, cleaning costs increase due to unnecessary cleaning element replacement.

These problems are a common occurrence due to the difficulties experienced by users in knowing the proper time to replace cleaning elements. The two methods commonly used to determine when to replace cleaning elements are highly inaccurate. In the first method, the user visually inspects the elements to determine the degree of wear. Users, however, typically have little experience or guidance concerning what is the maximum desired degree of cleaning element wear and often err on the side of removing the cleaning elements prematurely or when overworn. In the second method, the user times the replacement based on the cleaning machine operating hours. This method is often impractical as the operating hours of a cleaning machine often bear only a tangential relationship to cleaning element wear. The amount of cleaning element wear is dependent on not only operating hours but also the types of surfaces cleaned, the rate of rotation of the rotating disk or cylinder containing the cleaning elements, and the type of cleaning agents employed, if any. Operating hours are also difficult to track in most cases as cleaning machines typically do not record operating hours.

SUMMARY OF THE INVENTION

It is, therefore, an object of the present invention to monitor the wear of cleaning elements.

It is a further objective of the present invention to lower cleaning costs by avoiding premature replacement of the cleaning elements.

It is a further objective of the present invention to lower cleaning costs by avoiding the use of overworn cleaning elements.

It is a further objective of the present invention to substantially optimize cleaning element efficiency versus cleaning element replacement.

It is a further objective of the present invention to provide users with a simple and convenient apparatus that indicates when cleaning elements should be replaced.

The present invention discloses an apparatus for cleaning a surface including a plurality of cleaning and wear measuring elements connected to a mounting member. The length of each cleaning element decreases during usage. The length of each wear measuring element is less than the original (unworn) length of each cleaning element and corresponds to a predetermined wear length for the cleaning elements. The difference between the cleaning element and wear measuring element lengths at any point in time is directly related to the amount of remaining wear associated with the cleaning elements. It is desirable to replace the cleaning elements when the cleaning element lengths approximate the wear measuring element length.

The predetermined wear length of the cleaning elements, which is generally selected as the wear measuring element length, is preferably a function of the minimum desired cleaning efficiency of the cleaning elements, which is dependant upon the maximum desired stiffness of the cleaning elements.

The number of wear measuring elements on the mounting member depends upon the number and desired cleaning efficiency of the cleaning elements, the size and shape of the mounting member, and the visibility of the wear measuring elements on the mounting member. Preferably, the cleaning elements outnumber the wear measuring elements on the mounting member. In alternative embodiments, the wear measuring elements and cleaning elements may have substantially the same compositions and/or different colors.

The placement of wear measuring elements on the face of the mounting member is a function of factors including the visibility of the wear measuring elements on the face, the location of other wear measuring elements, the shape of the face, the wear pattern of the cleaning elements, and the locations of the cleaning elements on the face.

In a first embodiment of the present invention, the mounting member is substantially cylindrical. Various aspects of the first embodiment are possible based upon what portions of the mounting member are conveniently viewable to the user.

In a first aspect, the mounting member has at least three wear measuring elements substantially uniformly distributed around the circumference of the mounting member. The first aspect is preferably employed for dry sweeping and wet scrubbing applications where all or a portion of the mounting member is conveniently viewable by the user. As used herein, "dry cleaning" refers to the cleaning of a surface by the mounting member without a liquid cleaning agent. "Wet cleaning" refers to the cleaning of a surface by the mounting member with a liquid cleaning agent.

In a second aspect, the mounting member has at least one wear measuring element in each quadrant of the substantially circular cross section of the mounting member. The second aspect is preferably employed where cleaning elements are substantially uniformly distributed around the circumference of the mounting member and at least one portion of the mounting member is conveniently viewable by the user.

In a third aspect, the mounting member has first and second outer portions at each end of the mounting member and a middle portion between the first and second outer portions. The middle portion has a length that is between about one-third and one-fourth of the mounting member. The first and second outer portions each contain wear measuring elements with the middle portion being substantially free of wear measuring elements. The third aspect is preferably employed where cleaning elements are substantially uniformly distributed around the circumference of the mounting member and only the first and second outer portions of the mounting member are conveniently viewable by the user.

In a fourth aspect, each of the first and second outer portions and middle portion contain wear measuring elements. The fourth aspect is preferably employed where cleaning elements are substantially uniformly distributed around the circumference of the mounting member and the first and second outer portions and middle portion are conveniently viewable by the user.

In a fifth aspect, the middle portion contains wear measuring elements and the first and second outer portions are each substantially free of wear measuring elements. This aspect is preferably employed where cleaning elements are substantially uniformly distributed around the circumference of the mounting member and the middle portion but not the first and second outer portions, are conveniently viewable by the user.

In a second embodiment of the present invention, the mounting member has a substantially circular face containing wear measuring and cleaning elements. A peripheral portion of the face may contain wear measuring elements with an inner portion of the face being substantially free of wear measuring elements. Preferably, each quadrant of the substantially circular face contains at least one wear measuring element.

In both the first and second embodiments, a majority of the wear measuring elements should be separated by at least one cleaning element. A majority of the wear measuring elements should be adjacent to a cleaning element. At least a majority of the wear measuring elements should not be adjacent to another wear measuring element.

In another embodiment of the present invention, a first wear measuring element has a different length from a second wear measuring element. The lengths of the first and second wear measuring elements correspond to different degrees of cleaning element wear. In another embodiment of the present invention which may be used in connection with this embodiment, the first and second wear measuring elements have different colors.

The various embodiments of the present invention have numerous advantages over existing cleaning apparatuses. First, one embodiment of the present invention provides a simple and convenient apparatus to monitor cleaning element wear and indicate the time to replace the cleaning elements. The use of wear measuring elements adjacent to cleaning elements provides a visual cue to the remaining life of cleaning elements.

Second, in another embodiment of the present invention the wear measuring elements and cleaning elements may have different colors to facilitate the determination of when to replace cleaning elements. The colors of the cleaning elements and wear measuring elements may be selected to highlight the remaining cleaning element life.

Third, in a further embodiment of the present invention the wear measuring elements may be limited in number by being located only in visible locations on the disk or cylinder of the cleaning machine. In this manner, there will be little, if any, adverse impact on the efficiency of the cleaning machine over cleaning machines without wear measuring elements.

Fourth, another embodiment of the present invention substantially optimizes cleaning element efficiency versus replacement frequency. The wear measuring element length is keyed to the minimum desired length of the cleaning elements for the desired minimum degree of cleaning efficiency.

Finally, an embodiment of the present invention provides a low cost method to monitor cleaning element wear. The additional manufacturing cost to add a small number of wear measuring elements to a disk or cylinder is low, especially where the wear measuring elements are the same composition as the cleaning elements and interspersed among the cleaning elements.

DETAILED DESCRIPTION

Figure 1:
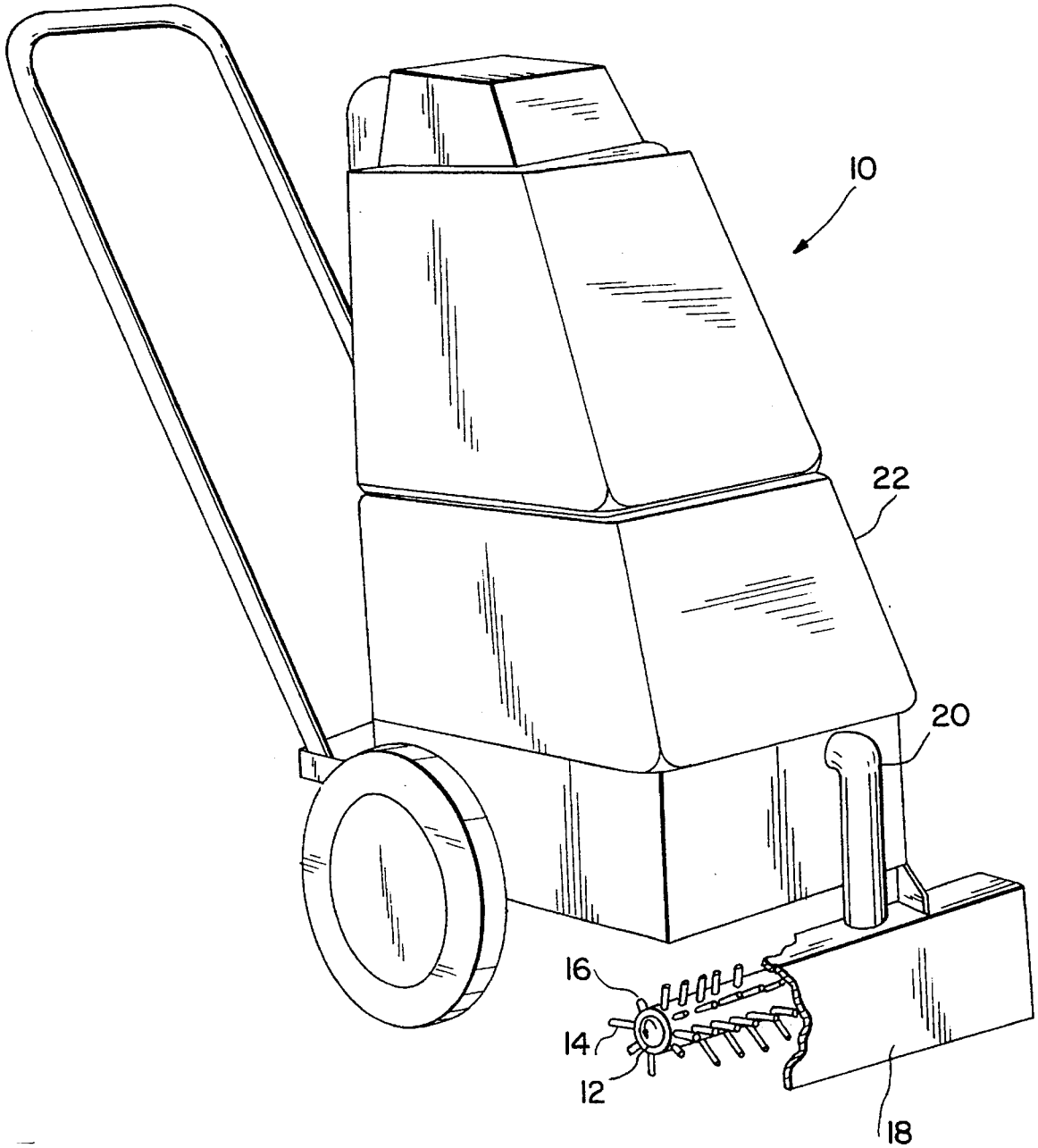
FIG. 1 is a perspective view of a cleaning machine with a portion of the shroud cut away to show a cylindrical mounting member with wear measuring elements.

FIG. 1, a first embodiment of the present invention, is a cleaning machine 10 having a mounting member 12. The mounting member 12 may be any size or shape depending upon the application, including either cylindrical or disk-shaped.

Mounting member 12 supports a plurality of cleaning elements 14 and wear measuring elements 16. Mounting member 12 is surrounded by vacuum shoe 18 to assist suction of dirt and other debris dislodged from a surface by cleaning elements 14 during rotation of mounting member 12 about its central axis. Suction through vacuum hose 20 carries the dislodged dirt and other debris to a collection reservoir in housing 22. Housing 22 may also contain a reservoir for a liquid cleaning agent which may be applied to the surface in wet cleaning applications to assist the removal of dirt and other debris by cleaning elements 14.

The length and diameter of mounting member 12 depends upon the particular application for the cleaning machine 10. The length of mounting member 12 ranges from about 1 to about 6 feet. The diameter of mounting member 12 ranges from about 1 to about 14 inches.

Cleaning elements 14 are desirably brushes with each brush being composed of a plurality of bristles. The bristles may be composed of a number of different types of materials including synthetic fibers, such as polyethylene (for cleaning hard surfaces) and nylon (for cleaning soft surfaces), and natural fibers. The length of cleaning elements 14 depends on the application and configuration of mounting member 12. For a cylindrical mounting member 12 of the type shown in FIGS. 2–5 that is used for wet cleaning applications, the length of cleaning elements 14 is at least about ¾ inches. For a cylindrical mounting member 12 of the type shown in FIGS. 2–5 that is used for dry cleaning applications, the length of cleaning elements 14 is at least about two and three-quarter inches. For a disk-shaped mounting member 12 of the type shown in FIGS. 7 and 8 that is used for wet cleaning applications, the length of cleaning elements 14 is at least about one and three-quarter inches. For a disk-shaped mounting member 12 of the type shown in FIGS. 7 and 8 that is used for dry cleaning applications, the length of cleaning elements 14 is at least about 5 inches.

The number and concentration of cleaning elements 14 on mounting member 12 is also application-specific. Desirably, each mounting member 12 supports from about 30 to about 1000 cleaning elements.

Figure 2:
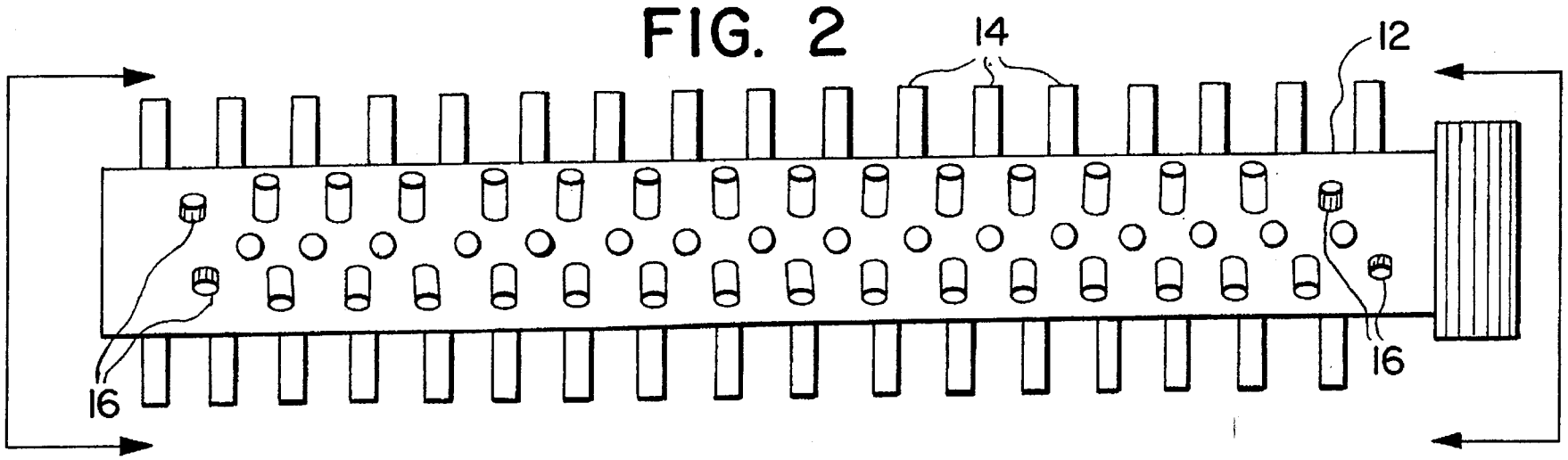
FIG. 2 is a side view of a cylindrical mounting member with wear measuring elements for cleaning of a surface.
Figure 3:
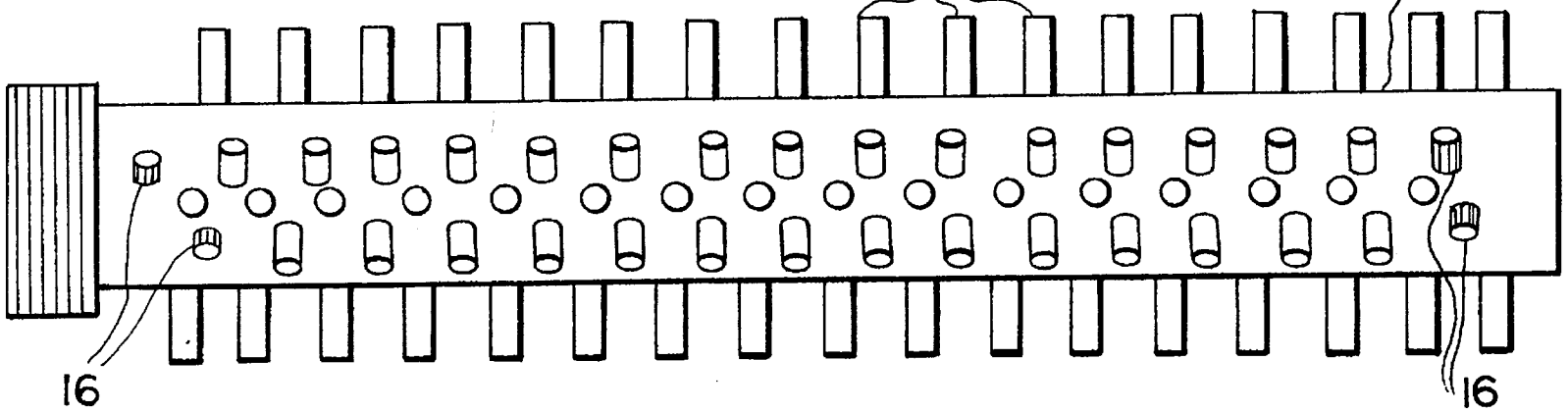
FIG. 3 is a view of the obverse side of the cylindrical mounting member in FIG. 2 with wear measuring elements.
Figure 5:
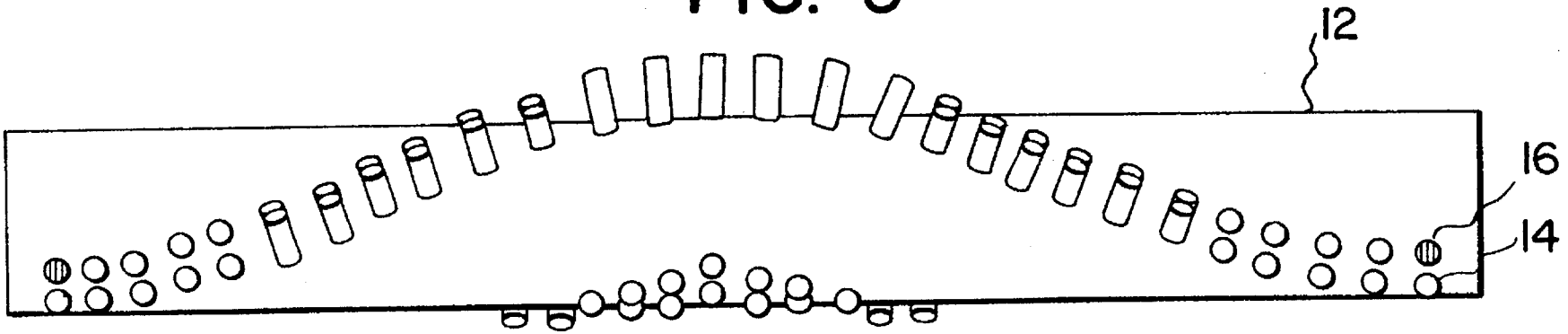
FIG. 5 is a side view of a cylindrical mounting member with wear measuring elements for cleaning of a surface.
Figure 6:
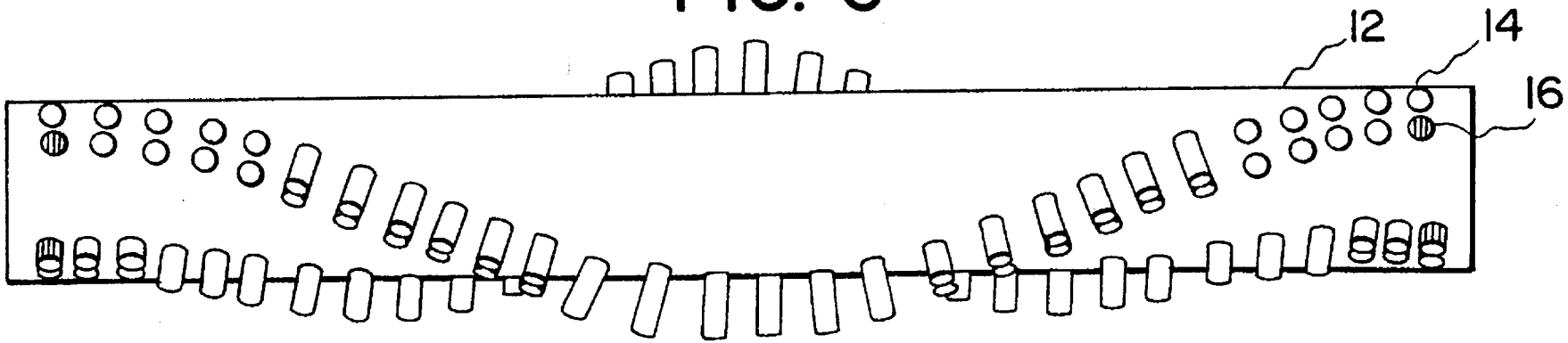
FIG. 6 is a view of the obverse side of the cylindrical mounting member in FIG. 5 with wear measuring elements.

The placement of cleaning elements 14 on mounting member 12 depends upon the cleaning element pattern on mounting member 12 desired for a particular application. In one configuration of the first invention, FIGS. 2 and 3 depict a first cleaning element pattern on mounting member 12 for use in wet and dry cleaning of hard and soft surfaces. In the first cleaning element pattern, cleaning elements 14 are located in a plurality of rows located substantially uniformly over the face of mounting member 12. In another configuration, FIGS. 5 and 6 depict a second cleaning element pattern for use in wet and dry cleaning of hard and soft surfaces. In the second cleaning element pattern, known as a herring-bone pattern, cleaning elements 14 are located in discrete ribbons in a herring-bone pattern on the face of mounting member 12. As will be appreciated, other cleaning element patterns may be used, including discrete ribbons of cleaning elements 14 in a spiral pattern on the face of mounting member 12.

Wear measuring elements 16 have a length corresponding to a predetermined wear length for cleaning elements 14. The difference between the length of cleaning elements 14 and wear measuring elements 16 at any point in time is directly related to the amount of remaining wear associated with (and remaining useful life for) cleaning elements 14. When the lengths of cleaning elements 14 decrease through wear to a length approximating the length of wear measuring element 16, it is desirable to replace cleaning elements 14 and/or mounting member 12, as appropriate. The wear measuring elements 16 have a longitudinal extent substantially less than the longitudinal extent of the mounting member 12.

In one embodiment of the present invention, the minimum desired length for cleaning elements 14 is roughly equal to the lengths of wear measuring elements 16. The minimum desired length for cleaning elements 14 depends upon the minimum desired cleaning efficiency for the cleaning-elements 14 on mounting member 12. The cleaning efficiency for cleaning elements 14 depends upon the relationship between the stiffness and length of cleaning elements 14. As will be appreciated, a cleaning element's stiffness generally increases as its length decreases. The increased stiffness will in turn adversely influence the ability of a cleaning element 14 to remove dirt and other debris from the desired surface. The minimum desired cleaning efficiency of cleaning elements 14 is related to the application for and configuration of mounting member 12.

For a cylindrical mounting member 12 of the type shown in FIGS. 2–6 that is used for wet cleaning applications, the length of wear measuring elements 16 is at least about ⅜ inches, or about 50% of the original (unworn) length of cleaning elements 14. For a cylindrical mounting member 12 that is used for dry cleaning applications, the length of wear measuring elements 16 is at least about ¾ inch, or about 25% of the original print (unworn) length of cleaning elements 14. For a disk-shaped mounting member 12 of the type shown in FIGS. 7–8 that is used for wet cleaning applications, the length of wear measuring elements 16 is at least about ½ inch, or about 25% of the original print (unworn) length of cleaning elements 14. For a disk-shaped mounting member 12 that is used for dry cleaning applications, the length of wear measuring elements 16 is at least about ¾ inch, or about 10 to 15% of the original print (unworn) length of cleaning elements 14.

In another embodiment of the present invention, wear measuring elements 16 have the same composition as cleaning elements 14. By way of example, cleaning elements 14 and wear measuring elements 16 are both preferably brushes whose bristles have the same composition. In this manner, when the lengths of cleaning elements 14 are worn to the length of wear measuring elements 16, mounting member 12 may continue to be operated without damage to the surface being cleaned from wear measuring elements 16 or adverse impact by wear measuring elements 16 on the cleaning efficiency of cleaning elements 14. In this manner, the replacement of cleaning elements 14 may be done at the time of the next periodic inspection of cleaning elements 14.

The number of wear measuring elements 16 on mounting member 12 depends upon the number and desired cleaning efficiency of cleaning elements 14, the size and shape of mounting member 12, and the visibility to the user of wear measuring elements 16 on mounting member 12. As shown in FIG. 2, cleaning elements 14 are located along adjacent first and second paths extending along the longitudinal extent of the mounting member 12. The wear measuring elements 16 are located within an area bounded by the first and second paths and the number of wear measuring elements in this area is less than 25% of the number of cleaning elements located along the first and second paths. As will be appreciated, wear measuring elements 16, being shorter than cleaning elements 14, do not normally contribute to the cleaning efficiency of mounting member 12. Accordingly, it is desired that as few as possible wear measuring elements 16 be utilized. Preferably, cleaning elements 14 outnumber wear measuring elements 16 on mounting member 12.

The placement of wear measuring elements 16 on mounting member 12 is a function of factors including the visibility of wear measuring elements 16 on mounting member 12, the location of other wear measuring elements 16 on mounting member 12, the shape of mounting member 12, the wear patterns of cleaning elements 14 on mounting member 12, and the locations of cleaning elements 14 on mounting member 12. Wear measuring elements 16 are desirably placed only in those portions of mounting member 12 that are conveniently viewable by the user, since in most applications the wear pattern of cleaning elements 14 is substantially uniform along the face of the mounting member 12.

Concerning the visibility of wear measuring elements 16, there are three primary techniques in cleaning machines to view mounting member 12. First, in some cleaning machines vacuum shoe 18 tilts or lifts up or out to reveal mounting member 12. In this case, the entire length of mounting member 12 is typically visible. Second, in some cleaning machines vacuum shoe 18 has an access door to reveal a portion of mounting member 12. In this case, a portion of mounting member 12 is typically not easily viewable. Finally, cleaning machine 10 may be tilted to rest on the handles to reveal mounting member 12. In this case, the entire length of mounting member 12 is typically visible.

Various aspects of the present invention exist based upon the visibility of wear measuring elements 16. In a first aspect of the present invention shown in FIGS. 5 and 6, mounting member 12 is substantially cylindrical and preferably has at least three wear measuring elements 16 substantially uniformly distributed around the circumference of mounting member 12. In one configuration, each end of mounting member 12 has at least three wear measuring elements 16 substantially uniformly distributed around the circumference of mounting member 12. In a second configuration, wear measuring elements 16 are in a middle portion of mounting member 12 between first and second outer portions with the first and second outer portions being substantially free of wear measuring elements 16. The middle portion is about one-third to two-thirds the length of mounting member 12. The first aspect is preferably employed where mounting member 12 is to be used to wet or dry clean a surface.

In a second aspect of the present invention, mounting member 12 is substantially cylindrical and preferably has at least one wear measuring element in each quadrant of the substantially circular cross-section of mounting member 12. Wear measuring elements 16 may be placed anywhere along the length of mounting member 12, depending upon visibility of the wear measuring elements to the user. The second aspect is preferably employed where cleaning elements are substantially uniformly distributed around the circumference of mounting member 12 and only one portion of mounting member 12 is conveniently viewable by the user.

In a third aspect of the present invention shown in FIGS. 1 and 2, mounting member 12 is substantially cylindrical and has a first and second outer portion at each end of mounting member 12 and a middle portion between the first and second outer portions with the middle portion having a length that is between about one-third and one-fourth of the length of mounting member 12. Preferably, the first and second outer portions contain wear measuring elements 16 with the middle portion being substantially free of wear measuring elements 16. More preferably, each of the first and second outer portions of mounting member 12 have more wear measuring elements 16 than the middle portion. Most preferably, the first and second outer portions each have at least one wear measuring element in each quadrant of the substantially circular cross-section of mounting member 12. The third aspect is preferably employed where cleaning elements 14 are substantially uniformly distributed around the circumference of mounting member 12 and the first and second outer portions, but not the middle portion, of mounting member 12 is conveniently viewable by the user.

Figure 11:
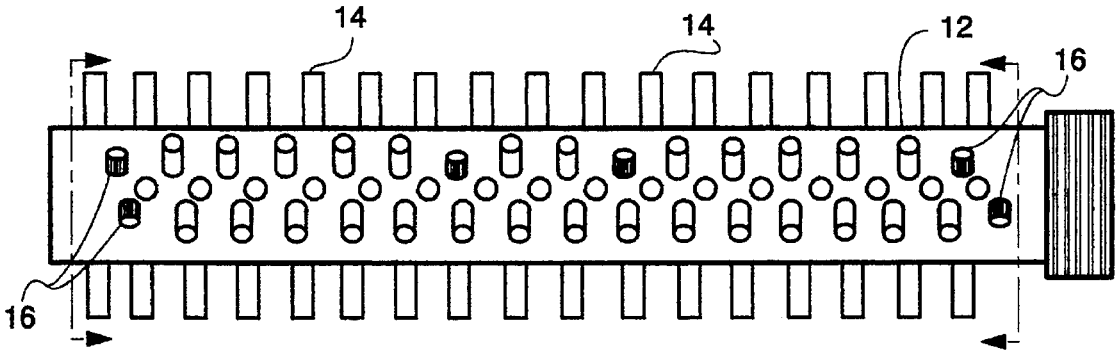
FIG. 11 is a side view of another embodiment of a cylindrical mounting member.
Figure 12:
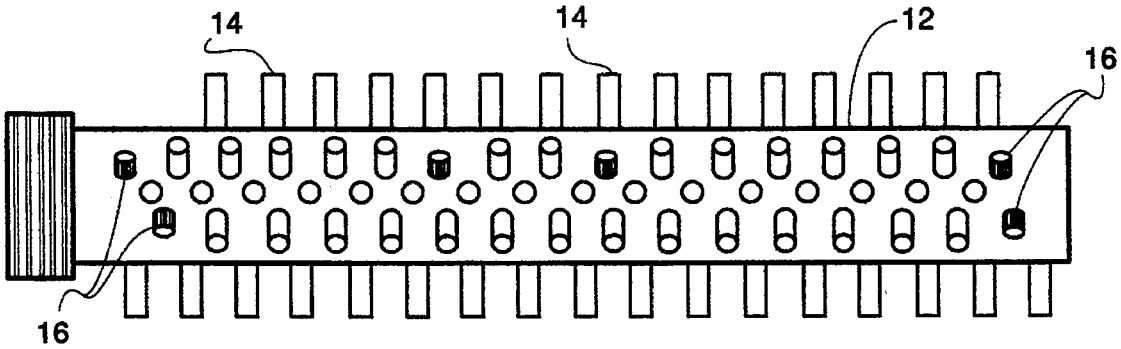
FIG. 12 is another side view of the embodiment of a cylindrical mounting member.

In a fourth aspect of the present invention illustrated in FIGS. 11 and 12, mounting member 12 is substantially cylindrical and has a first and second outer portion at each end of mounting member 12 and a middle portion between the first and second outer portions with the middle portion having a length that is between about one-third and one-fourth of the length of mounting member 12. Preferably, the first and second outer portions and middle portion each contain wear measuring elements 16. More preferably, the first and second outer portions and middle portion together have at least one wear measuring element 16 in each quadrant of the substantially circular cross-section of mounting member 12. Most preferably, each portion has at least one wear measuring element in each quadrant of the substantially circular cross-section of mounting member 12. The fourth aspect is preferably employed where cleaning elements 14 are substantially uniformly distributed around the circumference of mounting member 12 and when the first and second outer portions and middle portion of mounting member 12 are each conveniently viewable by the user.

Figure 13:
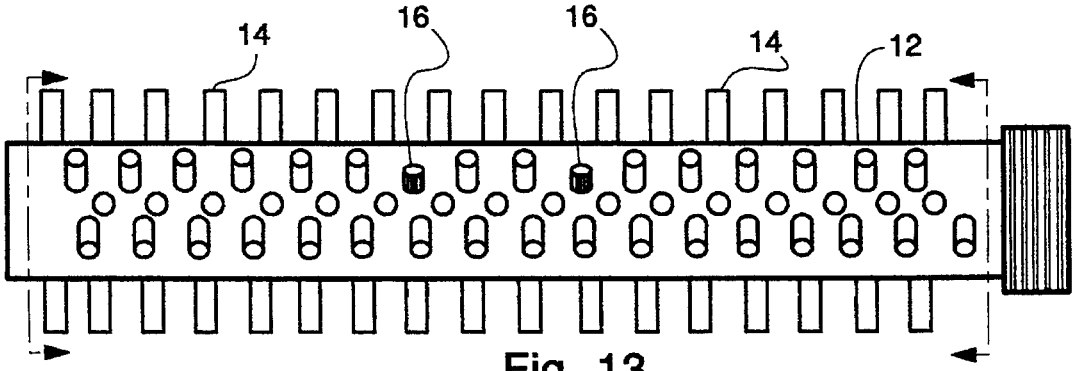
FIG. 13 is a side view of another embodiment of a cylindrical mounting member.
Figure 14:
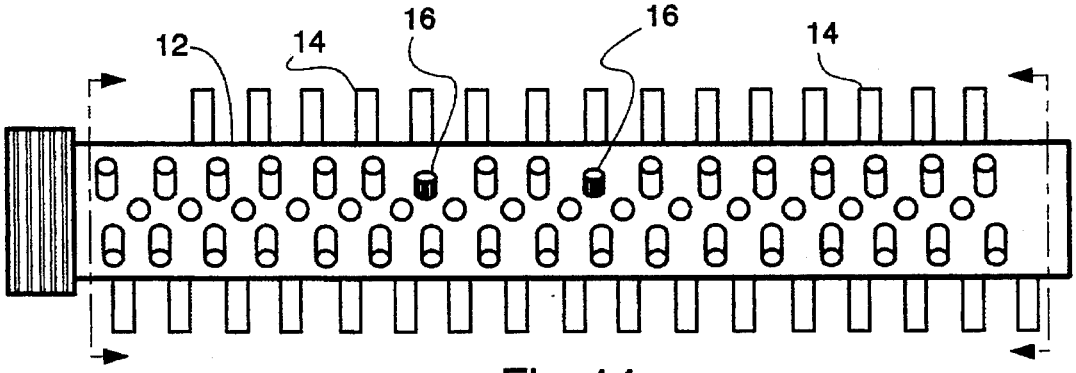
FIG. 14 is another side view of the embodiment of a cylindrical mounting member.

In a fifth aspect of the present invention illustrated in FIGS. 13 and 14, mounting member 12 is substantially cylindrical and has first and second outer portions and a middle portion therebetween having a length that is between about one-third and one-fourth of the length of mounting member 12. Preferably, the middle portion contains wear measuring elements 16 and the first and second outer portions are substantially free of wear measuring elements 16. More preferably, the middle portion of mounting member 12 has more wear measuring elements 16 than each of the first and second outer portions. Most preferably, the middle portion has at least one wear measuring element 16 per quadrant of the substantially circular cross-section of mounting member 12. The fifth aspect is preferred when cleaning elements 14 are substantially uniformly distributed around the circumference of mounting member 12 and only the middle portion is conveniently viewable by the user.

As will be appreciated, other configurations of wear measuring elements 16 on mounting member 12 are possible depending upon the parts of mounting member 12 that are conveniently viewable by the user.

By way of example, if multiple parts of mounting member 12 are conveniently viewable, wear measuring elements 16 may be placed in different quadrants of the substantially circular cross-section of mounting member 12 along the length of mounting member 12. Accordingly, if the first and second outer portions and middle portion of mounting member 12 are conveniently viewable, wear measuring elements 16 could be placed in different quadrants of the cross-section in each portion, such that no more than one wear measuring element 16 is located in any quadrant along the entire length of mounting member 12.

Also by way of example, wear elements 16 may be placed in either the first or second outer portions of mounting member 12 if the first and second outer portions are the only part of mounting member 12 that is conveniently viewable to the user. In that event, the other portions would preferably be substantially free of wear measuring elements 16, or, more preferably, have fewer wear measuring elements 16 than the conveniently viewable portion of mounting member 12.

To facilitate the visibility of wear measuring elements 16, one embodiment of the present invention uses wear measuring elements 16 having a different color than cleaning elements 14. Advantageously, the color difference may be highlighted by choosing contrasting colors. For example, cleaning elements 14 may be a dark color and wear measuring elements 16 may be a bright color or vice versa.

Notwithstanding the visibility of wear measuring elements 16, certain relationships regarding wear measuring element 16 placement are preferred. Preferably, a majority of wear measuring elements 16 is located adjacent to at least one cleaning element 14. More preferably a majority of wear measuring elements 16 are separated by at least one cleaning element 14. Most preferably, at least a majority of wear measuring elements 16 are not adjacent to another wear measuring element 16.

Figure 8:
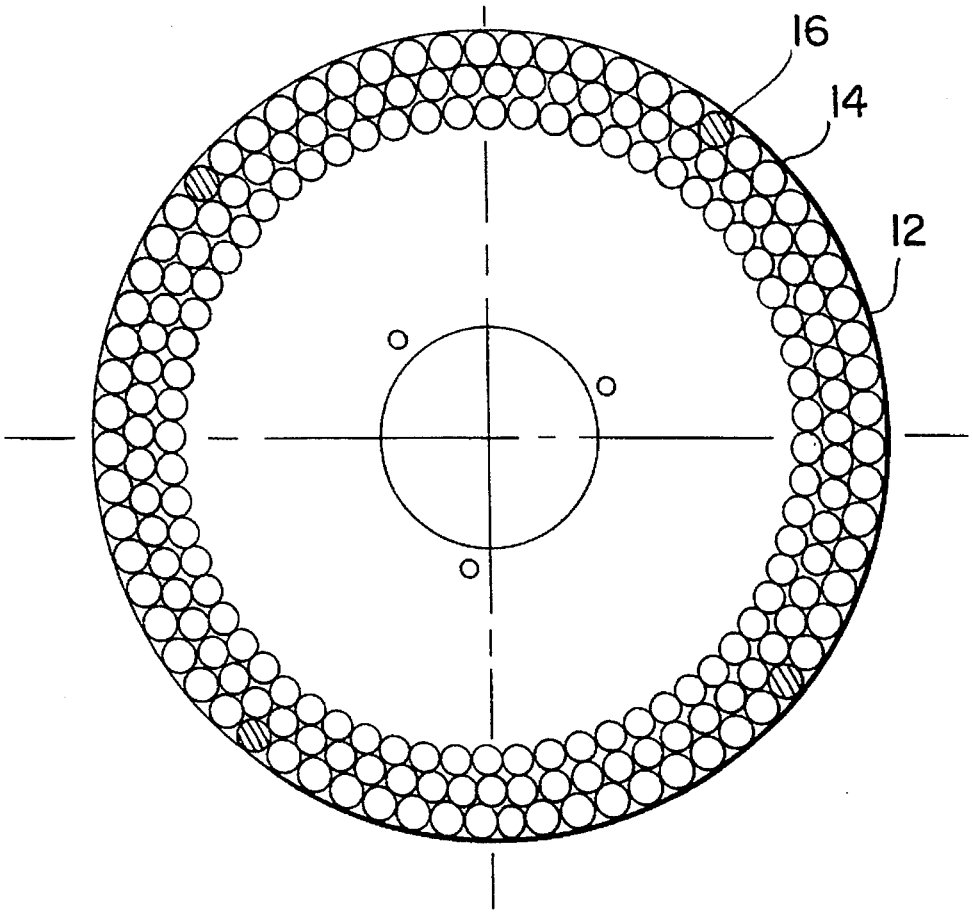
FIG. 8 is a bottom view of a disk-shaped mounting member with wear measuring elements in each quadrant of the disk-shaped mounting member.
Figure 4:
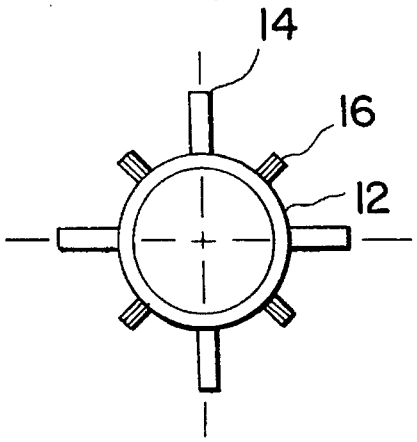
FIG. 4 is a cross-sectional view of the cylindrical mounting member taken along the lines shown in FIG. 2 to show at least one wear measuring element in each quadrant of the cross-section.
Figure 7:
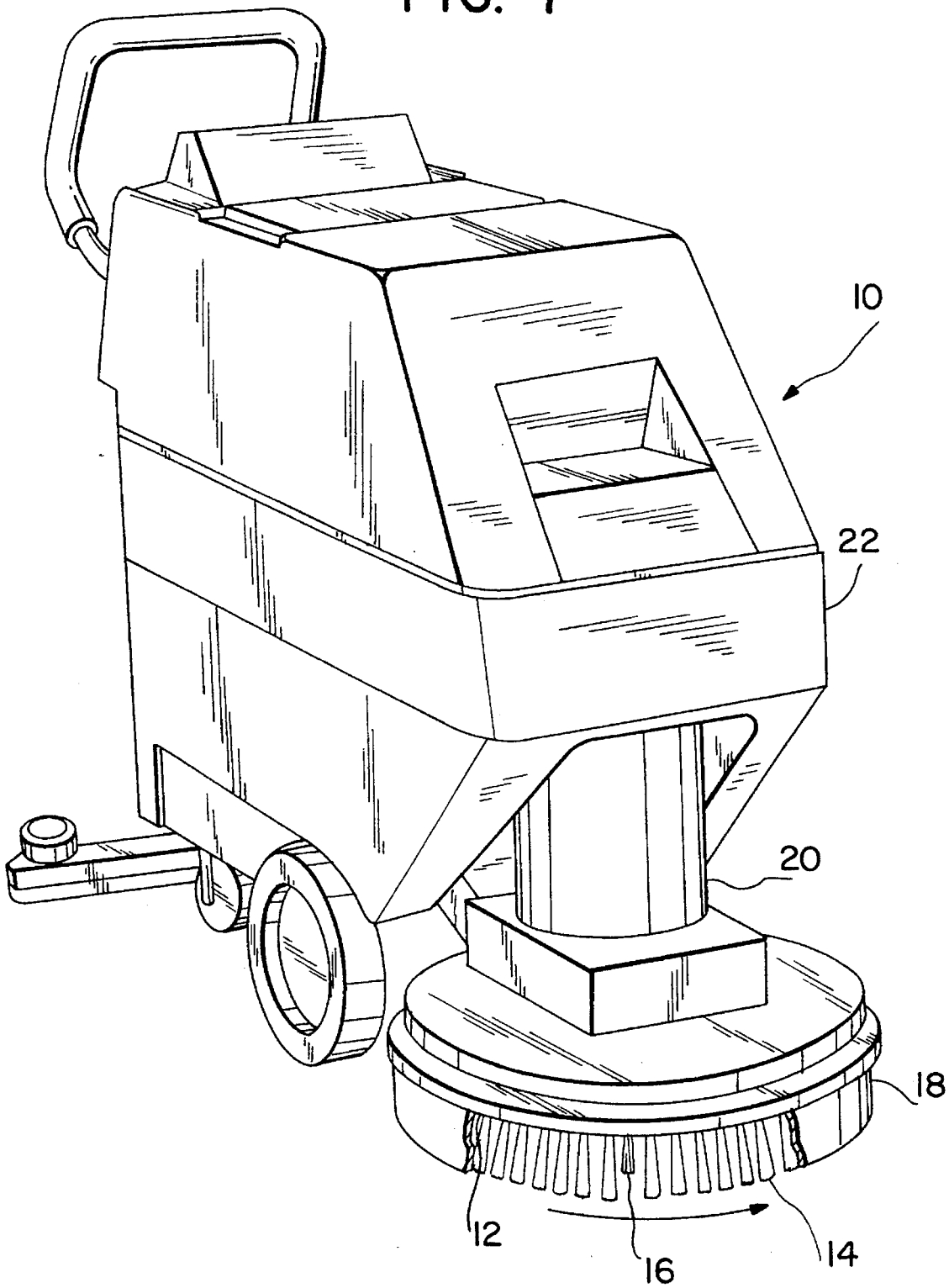
FIG. 7 is a perspective view of a cleaning machine with a portion of the shroud cut away to show a disk-shaped mounting member with wear measuring elements.

FIGS. 7 and 8 depict another embodiment of the present invention. The primary distinction between the embodiment in FIGS. 2–6 and this embodiment is that the former embodiment has a mounting member 12 that is substantially cylindrical and this embodiment has a mounting member 12 that is substantially circular or disk-shaped. More particularly, mounting member 12 in this embodiment has a substantially circular face that supports cleaning elements 14 and wear measuring elements 16, the cleaning elements 14 simultaneously contacting a surface to be cleaned during cleaning. Cleaning elements 14 are located along adjacent first and second curved closed paths on an outer peripheral portion of the disk-shaped mounting member as shown in FIG. 8. This embodiment is primarily used for wet and dry cleaning applications.

Wear measuring elements 16 are located in a peripheral portion of mounting member 12 with each quadrant of the substantially circular face of mounting member 12 having at least one wear measuring element 16. The number of wear measuring elements 16 is less than 25% of the number of cleaning elements 14 along the first and second curved paths. The inner portion of mounting member 12 is substantially free of wear measuring elements 16. More preferably, a majority of wear measuring elements 16 are located in the peripheral portion and most preferably at a majority of wear measuring elements 16 are located in the peripheral portion.

In another embodiment of the present invention, wear measuring elements 16 have different lengths corresponding to different degrees of wear for cleaning elements 14. The number of different lengths of the wear measuring elements and the magnitudes of the lengths depend upon the magnitude of the difference between the original (unworn) length of cleaning elements 14 and the predetermined wear length for cleaning elements 14.

Figure 9:
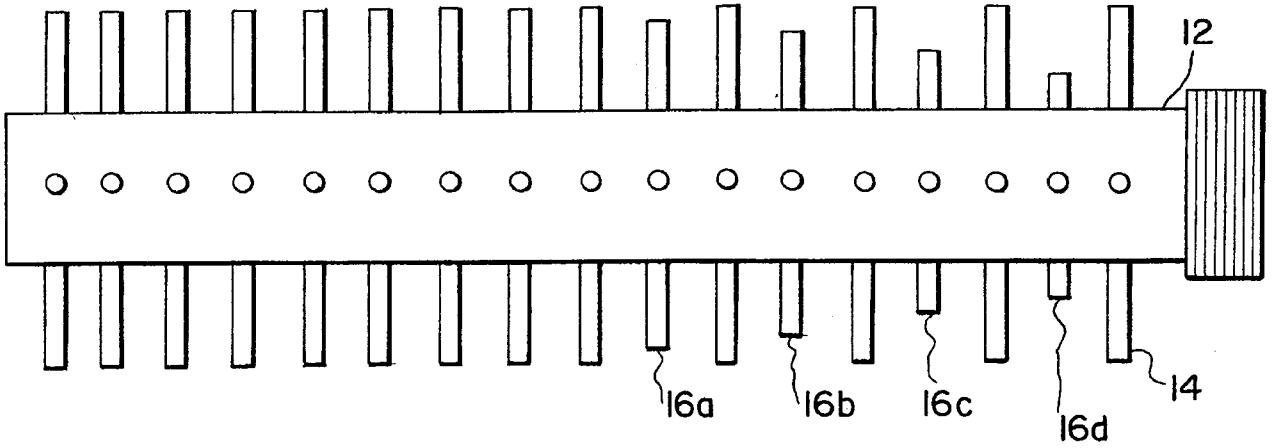
FIG. 9 is a side view of a cylindrical mounting member showing wear measuring elements of different lengths.

In one configuration shown in FIG. 9, mounting member 12 has wear measuring elements 16*a*, 16*b*, 16*c*, and 16*d*, with wear measuring element 16*a* being longer than wear measuring element 16*b*, wear measuring element 16*b* being longer than wear measuring element 16*c*, and wear measuring element 16*c* being longer than wear measuring element 16*d*. Preferably, for cleaning elements having an original (unworn) length of at least about 3 inches and a predetermined wear length of no more than about 1 inch, wear measuring element 16*a* has a length corresponding to about 75% of the difference between the original length of cleaning element 14 and the predetermined wear length, 16*b* to about 50% of the difference and 16*c* to about 25% of the difference. Wear measuring element 16*d* preferably has a length corresponding to the predetermined wear length.

In another configuration, for cleaning elements having an original (unworn) length between about 1.25 inches and 3 inches and a predetermined wear length of no more than about ¾ inches, some wear measuring elements have lengths corresponding to about 50% of the difference between the original length of cleaning elements 14 and the predetermined wear length and other wear measuring elements have lengths corresponding to the predetermined wear length. In another configuration which may be used with either of the above configurations, the wear measuring elements 16 have a different color for each of the different wear measuring element lengths. For example, wear measuring elements 16*a*, 16*b*, 16*c*, and 16*d* in FIG. 9 are each of a different color.

Figure 10:
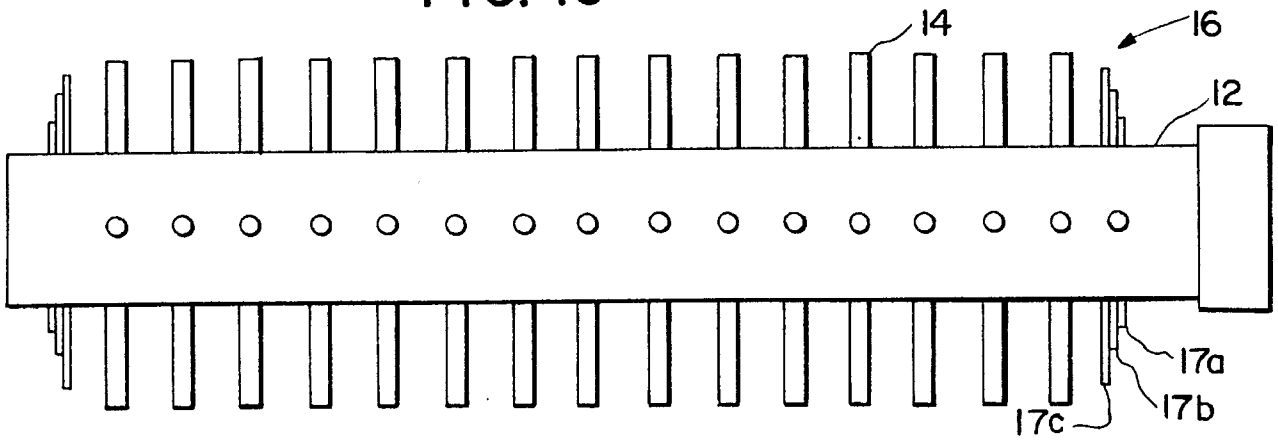
FIG. 10 is a side view of a cylindrical mounting member showing wear measuring elements having portions of different lengths.

As will be appreciated, other configurations of the present invention that incorporate the teachings of this embodiment are possible. In one such configuration shown in FIG. 10, portions of each wear measuring element are of different lengths and/or colors with each length and/or color corresponding to a different degree of cleaning element wear. Wear measuring element 16 has, for example, three portions, 17*a*, 17*b*, and 17*c*. Wear measuring element portion 17*c* corresponds to a first degree of cleaning element wear and is longer than wear measuring element portion 17*b*, wear measuring element portion 17*b* corresponds to a second degree of cleaning element wear and is longer than wear measuring element portion 17*a*, and wear measuring element portion 17*a* corresponds to a third degree of cleaning element wear. Such wear measuring elements 16 may accurately indicate the approximate degree of cleaning element wear at various points during the life of the cleaning element 14.

In operation, mounting member 12 is periodically viewed by the user during operation to ascertain the relative lengths of cleaning elements 14 and wear measuring elements 16. As mounting member 12 is operated, the lengths of cleaning elements 14 will become progressively shorter. When the relative lengths are approximately equal, mounting member 12 and/or cleaning elements 14 are replaced.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. An apparatus for cleaning a surface comprising:

a mounting member having ends and having a longitudinal extent that spans an entire length thereof;

a plurality of cleaning elements connected to said mounting member for cleaning a variety of surfaces and including at least a first cleaning element having a first length that decreases during usage, with some of said cleaning elements being located along adjacent first and second paths that extend along said longitudinal extent; and a plurality of wear measuring elements connected to said mounting member that are normally separated from said surfaces to be cleaned when the cleaning elements are in cleaning contact therewith to inhibit wear measuring element wear and including at least a first wear measuring element having a second length that is less than said first length and corresponds to a predetermined wear length for said first cleaning element;

wherein the difference between said first and second lengths is directly related to an amount of remaining wear associated with said first cleaning element and at least one of said wear measuring elements is located within an area bounded by and including said first and second paths, with the number of said wear measuring elements located within said area being less than 25% of the number of said cleaning elements located along said first and second paths to provide cleaning efficiency.

2. The apparatus, as claimed in claim 1, wherein said mounting member comprises first and second outer portions at each end of said mounting member and a middle portion between said first and second outer portions with said middle portion having a length that is between about one-third and one-fourth of said longitudinal extent of said mounting member, and wherein said first and second outer portions comprise said wear measuring elements and said middle portion is substantially free of said wear measuring elements.

3. The apparatus, as claimed in claim 1, wherein said mounting member has two ends and comprises first and second outer portions at each end of said mounting member and a middle portion between said first and second outer portions with said middle portion having a length that is between about one-third and one-fourth of said longitudinal extent of said mounting member, and wherein each of said first and second outer portions and said middle portion comprise said wear measuring elements.

4. The apparatus, as claimed in claim 1, wherein said mounting member has two ends and comprises first and second outer portions at each end of said mounting member and a middle portion between said first and second outer portions with said middle portion having a length that is between about one-third and one-fourth of said longitudinal extent of said mounting member, and wherein said middle portion comprises said wear measuring elements and said first and second outer portions are each substantially free of said wear measuring elements.

5. The apparatus, as claimed in claim 1, wherein said cleaning elements are a different color from said wear measuring elements.

6. The apparatus, as claimed in claim 1, wherein a majority of said wear measuring elements are not adjacent to another said wear measuring element.

7. The apparatus, as claimed in claim 1, wherein a first wear measuring element has a length and a second wear measuring element has a length and the lengths of the first and second wear measuring elements are different.

8. The apparatus, as claimed in claim 7, wherein the length of the first wear measuring element corresponds to a first degree of cleaning element wear and the length of the second wear measuring element corresponds to a second degree of cleaning element wear and the first and second degrees of cleaning element wear are different.

9. The apparatus, as claimed in claim 7, wherein the first wear measuring element has a first color and the second wear measuring element has a second color and the first and second colors are different.

10. The apparatus, as claimed in claim 1, wherein said wear measuring element has a longitudinal extent substantially less than said longitudinal extent of said mounting member.

11. The apparatus, as claimed in claim 1, wherein said cleaning elements include one or more bristles.

12. The apparatus, as claimed in claim 1, wherein at least two of said wear measuring elements are located in said area and separated by one or more cleaning elements.

13. The apparatus, as claimed in claim 1, wherein said wear measuring elements are interspersed among said cleaning elements.

14. The apparatus as claimed in claim 1 wherein said cleaning elements include at least first and second cleaning elements with said first cleaning element wearing faster than said second cleaning element and in which said first wear measuring element is located adjacent to said first cleaning element.

15. The apparatus, as claimed in claim 1, wherein said mounting member has two ends and comprises first and second outer portions at each end of said mounting member and a middle portion between said first and second outer portions with said middle portion having a length that is between about one-third and one-fourth of said longitudinal extent of said mounting member, and wherein said first outer portion comprises said wear measuring elements and said second outer portion and middle portion are each substantially free of said wear measuring elements.

16. An apparatus for cleaning a surface comprising:

a mounting member;

a plurality of cleaning elements connected to said mounting member and including at least a first cleaning element having a first length that decreases during usage, with some of said cleaning elements located along adjacent first and second curved closed paths, with substantially all of said cleaning elements simultaneously contacting said surface during the cleaning of said surface; and a plurality of wear measuring elements connected to said mounting member and including at least a first wear measuring element having a second length that is less than said first length and corresponds to a predetermined wear length for said first cleaning element;

wherein the difference between said first and second lengths is directly related to an amount of remaining wear associated with said first cleaning element, with the number of said wear measuring elements being less than 25% of the number of said cleaning elements located along said first and second curved closed paths.

17. The apparatus, as claimed in claim 16, wherein said cleaning elements include one or more bristles.

18. The apparatus, as claimed in claim 16, wherein there are at least two of said wear measuring elements separated by one or more cleaning elements.

19. The apparatus as claimed in claim 16, wherein said wear measuring elements are normally separated from a surface to be cleaned when said cleaning elements are in cleaning contact with said surface.

20. The apparatus, as claimed in claim 16, wherein said cleaning elements include at least first and second cleaning elements with said first cleaning element wearing faster than said second cleaning element and in which said first wear measuring element is located adjacent to said first cleaning element

21. The apparatus, as claimed in claim 16, wherein said mounting member has a substantially curved face having an inner portion and an outer peripheral portion, said outer portion of said face comprises said wear measuring elements and cleaning elements, and inner portion of said face is free of said cleaning elements and is free of said wear measuring elements.

22. The apparatus, as claimed in claim 16, wherein said cleaning elements have a different color from said wear measuring elements.

23. The apparatus, as claimed in claim 16, wherein all of said cleaning elements are connected to a substantially planar surface of said mounting member.

* * * * *